US007540941B2

(12) United States Patent
Lipponen et al.

(10) Patent No.: US 7,540,941 B2
(45) Date of Patent: Jun. 2, 2009

(54) METHOD AND APPARATUS IN THE SURFACE SIZING OF A PAPER OR BOARD WEB

(75) Inventors: Juha Lipponen, Kerava (FI); Pekka Pakarinen, Jyväskylä (FI); Juha Pakarinen, Jyväskylä (FI); Kari Holopainen, Muurame (FI); Juhani Vestola, Jyväskylä (FI); Arto Tuomi, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 451 days.

(21) Appl. No.: 10/559,598

(22) PCT Filed: Jun. 7, 2004

(86) PCT No.: PCT/FI2004/000345

§ 371 (c)(1),
(2), (4) Date: Jan. 3, 2006

(87) PCT Pub. No.: WO2004/109015

PCT Pub. Date: Dec. 16, 2004

(65) Prior Publication Data

US 2006/0124263 A1 Jun. 15, 2006

(30) Foreign Application Priority Data

Jun. 5, 2003 (FI) ..... 20030842

(51) Int. Cl.

| | |
|---|---|
| ***D21H 19/84*** | (2006.01) |
| ***D21H 19/80*** | (2006.01) |
| ***D21H 21/16*** | (2006.01) |
| ***B05C 1/04*** | (2006.01) |
| ***B05C 3/15*** | (2006.01) |
| ***B05C 9/04*** | (2006.01) |

(52) U.S. Cl. ..... 162/265; 162/135; 162/137; 118/50; 118/223; 427/209; 427/296

(58) Field of Classification Search ..... 162/119, 162/123, 127, 128, 134–137, 158, 175, 178, 162/183, 184, 204, 205, 206, 207, 265; 118/50, 118/325, 410, DIG. 4, 231, 216, 223, 225, 118/226; 427/209, 294, 296, 350, 369, 179
See application file for complete search history.

(56) References Cited

U.S. PATENT DOCUMENTS 3,850,673 A 11/1974 Nelson (Continued)

FOREIGN PATENT DOCUMENTS

CA 2 376 255 A1 1/2001

OTHER PUBLICATIONS

Search Report issued in FI20030842.

(Continued)

*Primary Examiner*—Eric Hug
(74) *Attorney, Agent, or Firm*—Stiennon & Stiennon

(57) ABSTRACT

An applicator device (1) applies surface size to at least one side of a web (W). A pressure effect is applied to the web (W) by subjecting the web (W) to an underpressure and/or to an overpressure such that surface size is forced to penetrate into the pores of the web. Most advantageously, an underpressure is created that sucks applied surface size from the surface of the web (W) into the pores in the inner layers. Surface size is applied to a web first side ($W_1$) and a vacuum effect is applied to the web's opposite side (W2) to cause air to flow through the web (W) such that surface size moves from the first side ($W_1$) in the direction of the second side ($W_2$) into the web (W). Correspondingly, both sides of the web (W) can be treated in successive stages.

9 Claims, 9 Drawing Sheets

U.S. PATENT DOCUMENTS

| | | | | | |
|---|---|---|---|---|---|
| 4,102,299 | A | * | 7/1978 | Wallsten | 118/50 |
| 4,340,011 | A | | 7/1982 | Wahren et al. | |
| 5,486,381 | A | * | 1/1996 | Cleveland et al. | 427/294 |
| 5,756,156 | A | * | 5/1998 | Elijoki et al. | 427/316 |
| 6,103,066 | A | * | 8/2000 | Laapotti | 162/193 |
| 6,187,142 | B1 | * | 2/2001 | Heinzmann et al. | 162/135 |
| 6,994,771 | B1 | * | 2/2006 | Korhonen et al. | 162/202 |
| 7,175,710 | B2 | * | 2/2007 | Metzger et al. | 118/410 |
| 2002/0124796 | A1 | * | 9/2002 | Mendez-Gallon | 118/50 |
| 2002/0164428 | A1 | | 11/2002 | Halmschlager et al. | |

FOREIGN PATENT DOCUMENTS

| | | | | |
|---|---|---|---|---|
| FI | 108993 | B | | 5/2002 |
| WO | WO 99/67466 | A1 | | 12/1999 |
| WO | WO 02/072952 | | * | 9/2002 |
| WO | WO 03/004769 | A1 | | 1/2003 |
| WO | WO 03/004770 | A1 | | 1/2003 |
| WO | WO 2004/109015 | A2 | | 12/2004 |
| WO | WO 2004/109015 | A3 | | 12/2004 |

OTHER PUBLICATIONS

International Preliminary Report on Patentability issued in PCT/FI2004/000345.

International Search Report and Written Opinion of the International Searching Authority issued in PCT/FI2004/000345.

* cited by examiner

METHOD AND APPARATUS IN THE SURFACE SIZING OF A PAPER OR BOARD WEB

CROSS REFERENCES TO RELATED APPLICATIONS

This application is a U.S. national stage application of International App. No. PCT/FI2004/000345, filed Jun. 7, 2004, the disclosure of which is incorporated by reference herein, and claims priority on Finnish App. No. 20030842, Filed Jun. 5, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method in the surface sizing of a paper or board web, in which method surface size, such as a starch solution, is applied by means of an applicator device to at least one side of the web to be surface sized, and in which surface sizing is performed per one side of said web in one or more stages. The invention also relates to an apparatus in the surface sizing of a paper or board web, which apparatus has been arranged to apply surface size, such as a starch solution, by means of an applicator device in one or more stages to at least one side of the web to be surface sized.

In the manufacture of writing papers and many packing boards, surface sizing is used in which a dilute starch solution is applied to a paper or board web.

However, the object of surface sizing is not only to form a special layer onto the surface of the web that is being treated, but the size, such as a dilute starch solution, must penetrate to a certain extent into the web to bind the fibers in the surface layer of the web into a homogeneous layer. Several different methods and apparatuses are known in the prior art for spreading and applying size to the paper or board web. These prior-art methods and apparatuses include, among other things, pond coating, in which the web to be coated is passed through a size press nip formed by rolls, and a size pond is arranged on the incoming side of the nip in the closing gap defined by the rolls, the web to be coated being passed through said size pond. Another known coating and surface sizing method is film transfer coating, in which coating material or size is spread in a suitable fashion, for example, using a blade or a rod to form a film on the surface of a film press roll, from which said film is then transferred in a nip between the film press rolls from the surface of the roll to the web which runs through the nip and which is being coated. The coating methods known in the art further include different blade coating arrangements, in which, for example, the web to be coated or surface sized is passed over a backing roll and coating material or equivalent surface size is spread and smoothed onto the web by means of a blade coater. The spreading of size onto the web can also be arranged to take place, for example, by means of a jet applicator in accordance with Finnish Patent No. 108993, a curtain coating device or a spray applicator, which represent the latest surface sizing techniques. By means of the spray coating method, a very even coating material or surface size layer of desired thickness can be provided on the surface of the web.

Although the above-mentioned and previously known surface sizing methods are arrangements that are in use and operative, certain problems or different restrictions are associated with each of them. Thus, as known, in surface sizing the size material must be made to penetrate in a desired manner into the inner layers of the web. In particular, when surface sizing thicker packing boards, it is the penetration of starch that becomes a critical factor. In pond sizing, penetration can be made fairly good, but a significant drawback in this method is the speed limitation of the method. The speed cannot be raised to a very high level, among other things, because of the splashing of size material. In film sizing it is generally possible to use higher speeds, but in this surface sizing method, in particular with thick board grades, insufficient penetration of size material into the board web being treated becomes a problem. This is the case in spite of the fact that attempts are made to bring penetration to a desired level by means of the linear load prevailing in the size press nip. Spray and jet applicators are fairly well suited for use in the coating and surface sizing of thin paper and board grades and, in addition, fairly considerable speeds can be achieved by these coating methods. As such, however, these coating methods are not suitable for the manufacture of paper and board grades that require starch penetration because contact-free coating is used as the coating method.

To improve the penetration of surface size, it has been proposed previously that surface sizing be performed in two or more successive stages, for example, such that part of the total amount of size is first added to the web before the drying of the web is started by heating, and at least part of the total amount of size is added to the surface of the web after the drying has been started. One such method is described in the publication WO 03/004769. In the method described in this publication, the entire amount of size is thus not added in a single stage but in several stages. To improve penetration, the publication WO 03/004770 further proposes that the web be pressed in a nip between rolls after the addition of size.

SUMMARY OF THE INVENTION

An object of the present invention is to provide an arrangement which enables a starch solution to penetrate into the web to a desired depth. The object and aim of this invention is achieved by the method according to the invention, which method is characterized in that in connection with the application of surface size a pressure effect is applied to the web by subjecting the web to an underpressure and/or to an overpressure such that, by means of said pressure effect, surface size is forced to penetrate into the web into the pores of the web.

Advantageously, in the pores of the web an underpressure is created that sucks surface size applied to the surface of the web from the surface of the web into the pores in the inner layers. In that connection, surface size is applied to a first side of the web and a vacuum effect is applied to the opposite, that is, a second side, of the web to cause air to flow through the web such that surface size moves from the first side of the web in the direction of the second side of the web into the web. The application of surface size per one side of the web can be performed in one or more successive stages. The vacuum effect can also be applied to the web in one or more successive stages.

In accordance with one advantageous embodiment, the application of surface size to the web is started before the web is subjected to the effect of vacuum. The surface size can be applied to the web in its entirety before the vacuum effect is applied to the web. However, at least one layer of surface size is applied to the web before the web is subjected to the effect of vacuum and, after that, at least one further layer of surface size is applied to the web while the web is subjected to the effect of vacuum. The web can also be subjected to the effect of vacuum before the application of surface size to the web is started, so that the vacuum effect is continued after the point of application of surface size.

In accordance with another embodiment, surface size is applied to a first side of the web and a vacuum effect is applied to the same, that is, the first side of the web. In that connection, the vacuum effect is applied to the web before the application of surface size to the web is started. The application of surface size is started immediately when the application of the vacuum effect to the web is stopped. To keep the web balanced, a vacuum effect is also applied to the web on the opposite, that is, a second side of the web. Advantageously, in this embodiment, after the application of surface size, an overpressure effect is applied to the web to force surface size into the pores of the web.

The web can be surface sized on both sides in successive stages, so that the absorption of surface size into the pores of the web is enhanced by means of a pressure effect on both sides of the web. The penetration of surface size into the web can be controlled by controlling the pressure effect applied to the web. The vacuum level applied to the web is controlled and maintained in a range of 5-80 kPa, advantageously in a range of 5-40 kPa. The vacuum applied to the web is used for controlling the two-sidedness of the web. In two-sided surface sizing, the web is dried between the surface sizing of the different sides of the web.

The apparatus according to the invention is correspondingly characterized in that the apparatus comprises applicator devices for applying surface size to the web and devices for applying an underpressure and/or an overpressure to the web and for forcing surface size to penetrate into the web into the pores of the web. Advantageously, the apparatus comprises vacuum devices for creating an underpressure in the pores of the web to suck the surface size applied to the surface of the web from the surface of the web into the pores in the inner layers.

Advantageously, the vacuum devices are arranged to create a vacuum effect in the web on the side of the web opposite to the side to which surface size is applied to cause air to flow through the web and to transfer surface size from a first side of the web in the direction of a second side of the web into the web. The applicator devices can be arranged such that the application of surface size per one side of the web is performed in one or more successive stages.

In one embodiment, the applicator devices and the vacuum devices are arranged successively in the running direction of the web such that the vacuum effect created by the vacuum devices begins only after the application of surface size accomplished by the applicator devices. On the other hand, the vacuum devices can be arranged with respect to the applicator devices such that the vacuum effect on the web produced by the vacuum devices begins at least simultaneously with the size application point where the application of surface size is performed by the applicator devices. In addition, the vacuum devices can be arranged with respect to the applicator devices such that the application point of surface size is situated in the area of the vacuum effect.

The vacuum created by the vacuum devices is advantageously controllable. In one embodiment, the vacuum devices comprise a suction roll that can be provided with a suction zone which forms a vacuum effect area. The vacuum device can also be a suction box or a vacuum shoe.

The applicator devices can comprise a contact-free applicator device, in particular a spray coater. The applicator device can also be a film sizing device.

The invention provides a number of significant advantages over the present technique, out of which advantages, among other things, the following ones may be mentioned. The arrangement in accordance with the invention provides, in a process with no speed limitation, a complete starch penetration into the web that is being treated. The penetration of starch can be additionally controlled by means of vacuum independently of other process parameters, such as, for example, the viscosity of starch. The arrangement in accordance with the invention then enables a quick optimization of quality, for example, between stiffness and internal bond strength. The two-sidedness of the paper and board being treated with respect to different parameters can be controlled in a desired manner by means of the vacuum of the suction device belonging to the apparatus in accordance with the invention and by means of the starch penetration dependent on it. The other advantages and characteristic features of the invention come out from the following detailed description of the invention.

Next the invention will be described with reference to the figures of the appended drawing, but the invention is not narrowly limited to the examples shown in them.

DESCRIPTION OF THE PREFERRED EMBODIMENTS

Figure 1:
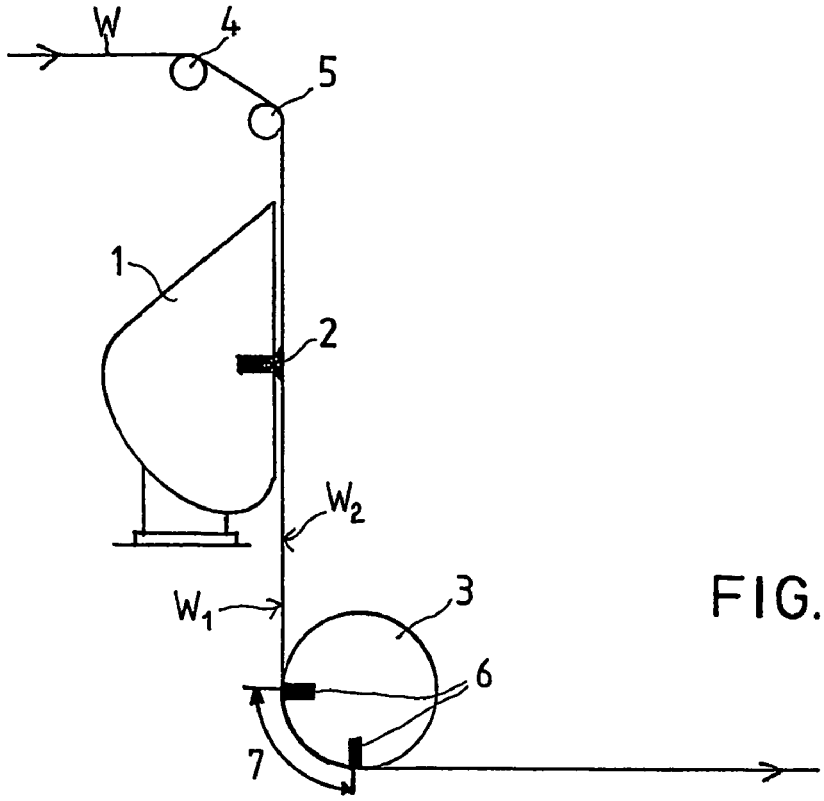
FIG. 1 schematically shows an example of the apparatus intended for carrying out the method in accordance with the invention, which apparatus is used for the treatment, i.e. surface sizing, of the web on one side.

In the method in accordance with the invention, the surface sizing of the web is performed in two stages such that in the first stage a starch solution is applied to one side of the web by means of an applicator device and in the second stage vacuum is created on the other side, or the opposite side, of the web by means of a separate vacuum device arranged on this opposite side for sucking the starch solution into the web. In FIG. 1, a web W is passed, while guided by guide and turning rolls 4, 5, past an applicator device 1, by which a starch solution is applied to a first side $W_1$ of the web. In the example of FIG. 1, the applicator device 1 is a spray coater, by which the starch solution is sprayed to the surface of the web W, i.e. to the first side $W_1$ of the web, in a contact-free manner by means of special nozzles 2.

In the running direction of the web W, after the applicator device 1, on the opposite side of the web W with respect to the applicator device 1, i.e. on the side of a second side $W_2$ of the web W, a vacuum device 3 is arranged for sucking the web W at its second side $W_2$ into contact with said vacuum device 3 by means of a vacuum acting in the vacuum device 3. The vacuum level used in the vacuum device 3 is so high that it suffices to cause air to flow through the web W. The vacuum level which is suitable and necessary is 5-80 kPa, but most advantageously of the order of 5-40 kPa. Using this pressure difference acting across the thickness of the web W, the starch solution moves from the first side $W_1$ of the web into the web W, in which connection it is possible to control the penetration of the starch solution by regulating the vacuum prevailing in the vacuum device 3. In the illustration of FIG. 1, as the vacuum device 3 is used a suction roll which includes, in a conventional manner, a suction zone 7 defined by axial seals 6 between themselves. After the vacuum device 3, the web W is passed to the necessary further treatment, for example, drying. In the illustration of FIG. 1, the stages of surface sizing are arranged clearly successively. Thus, in the embodiment of FIG. 1, the first stage, i.e. the application of surface size by means of the applicator device 1, is accomplished first and only after this is the vacuum produced by means of the vacuum device 3 on the opposite side of the web W to suck into the web W the surface size already applied.

Figure 2:
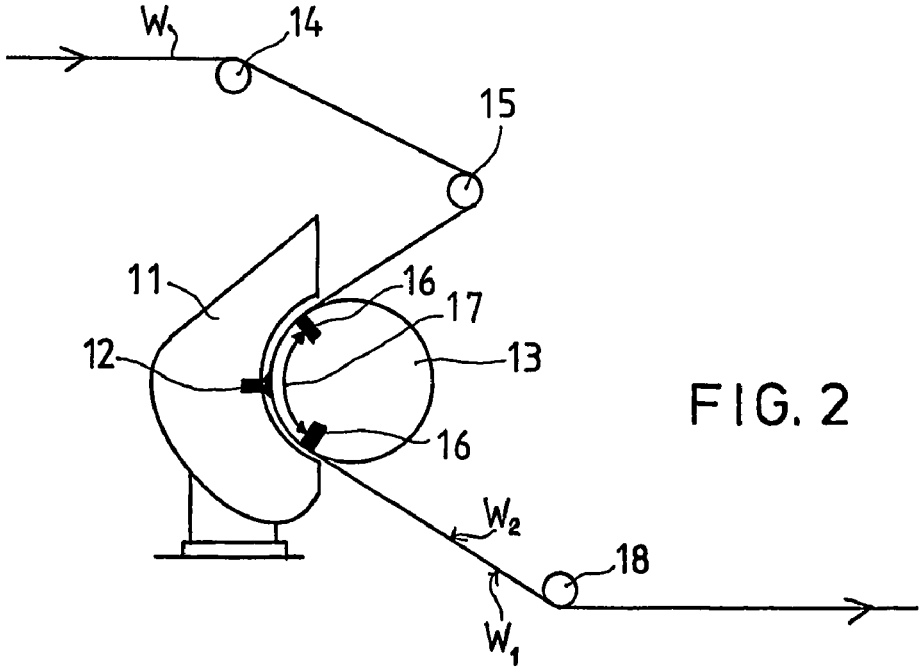
FIG. 2 schematically shows another example of the apparatus intended for carrying out the method in accordance with the invention, which apparatus is used for the treatment, i.e. surface sizing, of the web on one side.

FIG. 2 shows another embodiment of the invention different from that of FIG. 1. In FIG. 2, a web W is passed, while guided by guide and turning rolls 14, 15, to an applicator device 11, by which a starch solution is applied to a first side $W_1$ of the web. In the example of FIG. 2, a spray coater is also used as the applicator device 11 for spraying the starch solution to the surface of the web W, i.e. to the first side $W_1$ of the web, in a contact-free manner by means of special nozzles 12.

The embodiment of FIG. 2 differs from the illustration of FIG. 1 in that a vacuum device 13 arranged on the opposite side of the web W, i.e. on the side of a second side $W_2$ of the web W, is arranged at the nozzles 12 of the applicator device 11 on the other side of the web W. In this arrangement, the vacuum acting in the vacuum device 13 sucks the web W at its second side $W_2$ into contact with said vacuum device 13 at the same time and at the same location as surface size, such as a starch solution, is applied to the first side $W_1$ of the web by means of the applicator device. In the illustration of FIG. 2, as the vacuum device 13 is also used a suction roll in which a suction zone 17 is defined between axial seals 16. In the example of FIG. 2, the suction roll 13 is disposed such that the suction zone 17 clearly begins already before the nozzles 12 of the applicator device 11, so that suction is started already before the application of size. This kind of arrangement is thus also feasible, even though in the technical sense it is not necessary. The vacuum device 13, such as the suction roll shown in FIG. 2, can also be arranged such that the nozzles 12 are situated at the very beginning of the suction zone 17, so that suction begins to be effective immediately at the size application point. In this embodiment, the vacuum level used in the vacuum device 13 is also so high that it suffices to cause air to flow through the web W. A suitable vacuum level is also here considered to be 5-80 kPa, most advantageously of the order of 5-40 kPa. After the applicator device 11 and the vacuum device 13, the web W is passed over a guide and turning roll 18 to the necessary further treatment, for example, drying.

Figure 3:
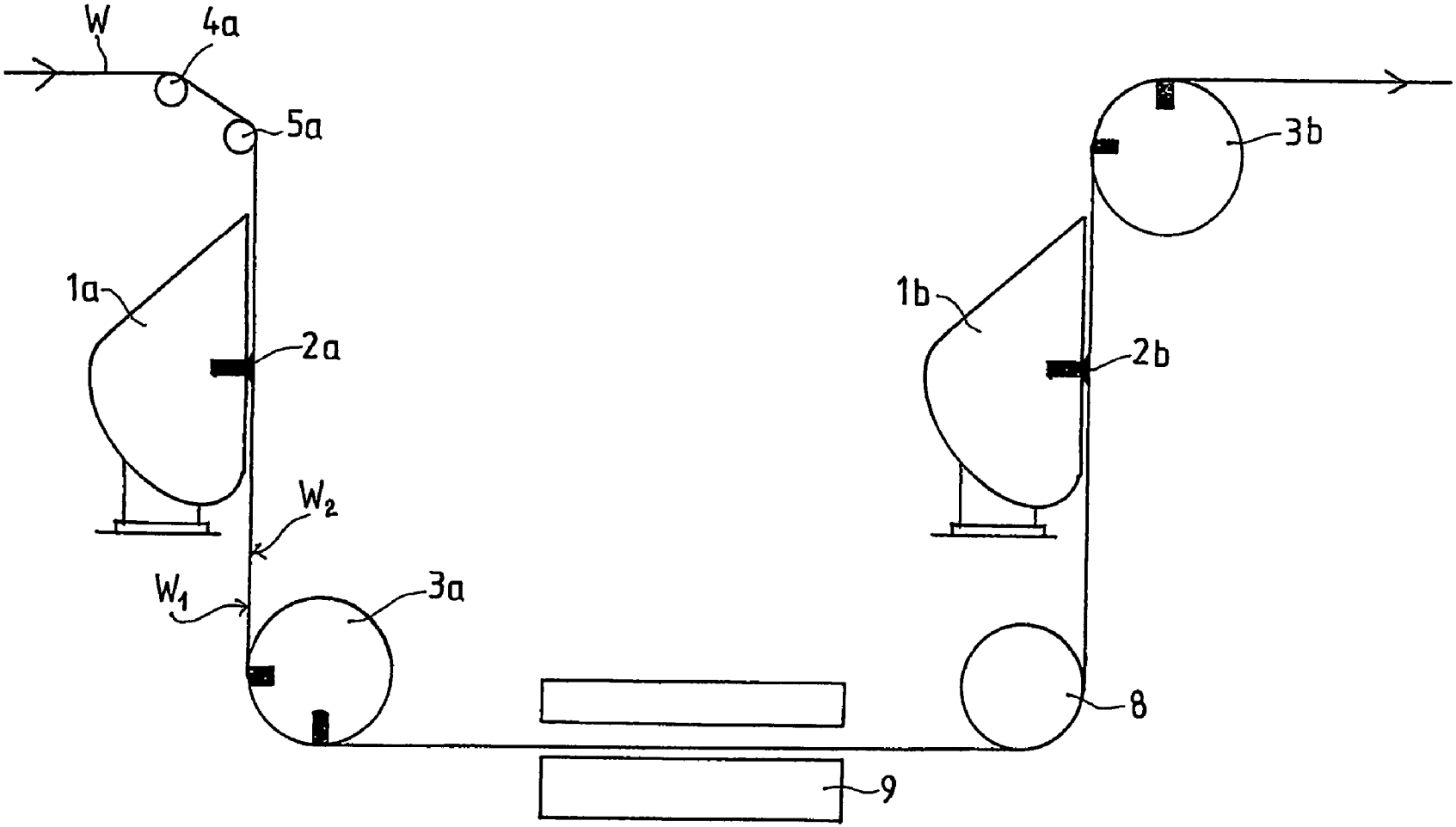
FIG. 3 schematically shows an example of the apparatus intended for carrying out the method in accordance with the invention, which apparatus is used for the treatment, i.e. surface sizing, of the web on both sides applying the size application method shown in FIG. 1.

While in the examples shown in FIGS. 1 and 2 the web W is surface sized only on one side, FIG. 3 correspondingly shows an example that is used for surface sizing the web W on both sides. In the example of FIG. 3, the web W is passed first to a first applicator device 1*a*, by which a starch solution is applied to a first side $W_1$ of the web. After that, the web W is passed to a first vacuum device 3*a*, and by means of a vacuum prevailing in said vacuum device a pressure difference is created across the thickness of the web W and the starch solution is caused to move and penetrate into the web W to a desired depth. In the example of FIG. 3, the surface sizing of the first side $W_1$ of the web is thus performed exactly as already described in connection with FIG. 1. In this respect, reference is made to FIG. 1. If it is desirable to surface size the web W on both sides, the applicator devices and the vacuum devices are arranged in succession, for example, in the manner shown in FIG. 3. In the example of FIG. 3, the web W is thus passed after the first vacuum device 3*a* by means of guide and alignment rolls 8, FIG. 3 showing only one of them, to a second applicator device 1*b* arranged on the other side of a second side $W_2$ of the web. In the example of FIG. 3, the second applicator device 1*b* is a spray applicator which is similar to that already described in connection with FIG. 2 and by which a starch solution is thus applied to the second side $W_2$ of the web in a contact-free manner by means of starch solution jets 2*b*. After the second applicator device 1*b* the web W is passed to a second vacuum device 3*b* arranged on the side of the first side $W_1$ of the web. This second vacuum device produces a vacuum by which the starch solution can be made to penetrate to a desired extent into the web W. In this regard, the operation fully corresponds to that already described in connection with FIG. 1. After the surface sizing of the first side $W_1$ of the web it may be necessary to dry the web W to at least some extent before its second side $W_2$ is surface sized. This is illustrated in FIG. 3 with a contact-free dryer which is designated by the reference numeral 9 and which dryer is, for example, an infrared dryer. FIG. 3 additionally shows turning and guide rolls which are designated by the reference numerals 4*a* and 5*a* and by which the running direction of the web W is turned in a desired manner. In surface sizing on both sides, the arrangement of the devices can also be, for example, as shown in FIG. 2.

In the examples of FIGS. 1-3, a spray applicator was proposed to be used as the applicator device. However, instead of this, as the applicator device it is also possible to use, for example, a film sizing device, a blade coater or equivalent. By using a contact-free spray applicator it is, however, possible to achieve certain differences with respect to other types of applicators, of which differences, among other things, the advantages in respect of the use of space as well as the advantage of speed may be mentioned. FIGS. 1-3 showed a suction roll 3, 13, 3*a*, 3*b* as the vacuum device but, instead of a suction roll, it is also possible to use other vacuum devices for producing a desired vacuum level. Different suction boxes, vacuum shoes and equivalent may be mentioned as examples of these. However, the suction roll may be considered to be the most advantageous in this regard because it does not cause an abrasive effect on the web W unlike, for example, a suction box.

Figure 4:
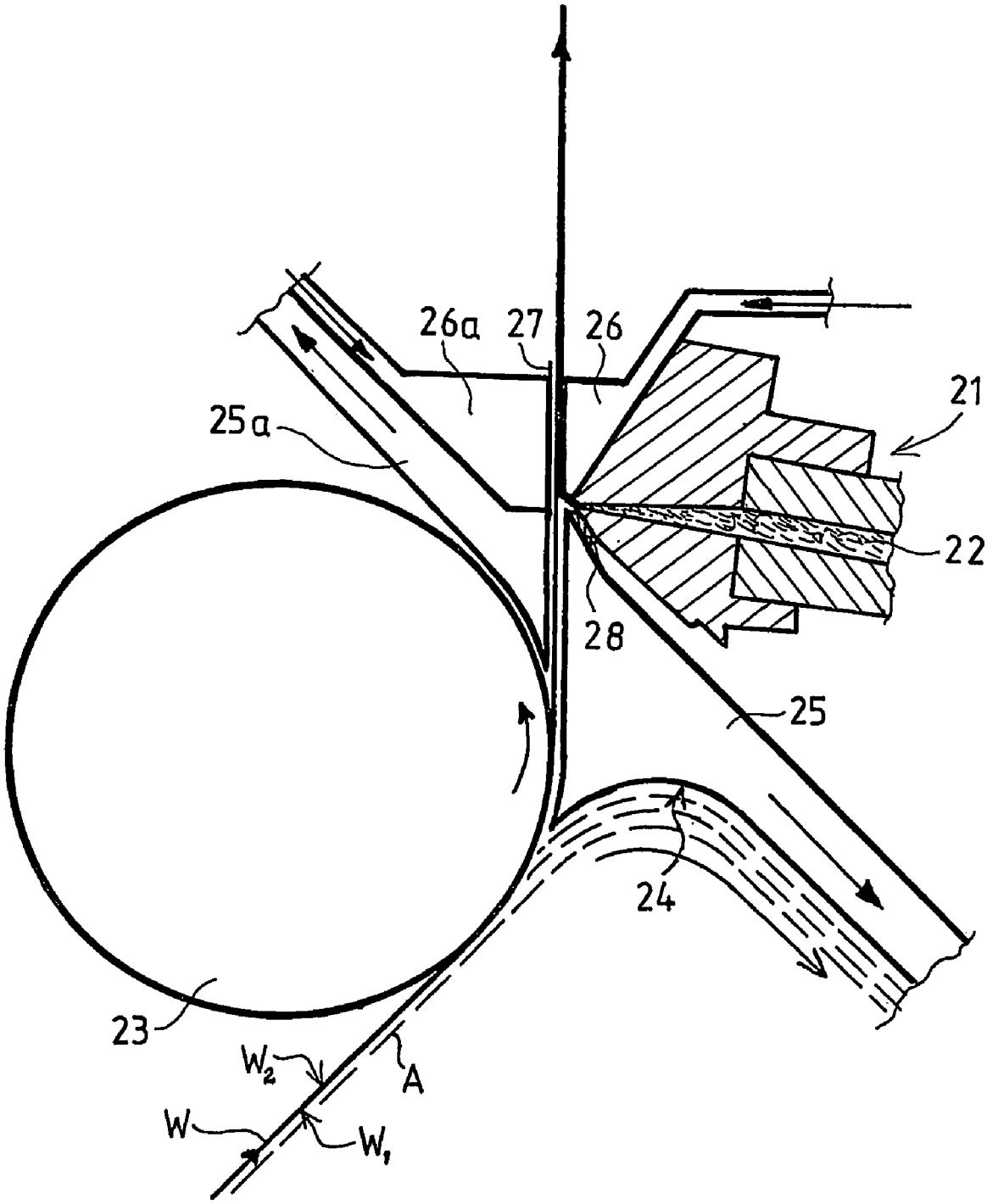
FIG. 4 shows another embodiment for improving the penetration of a coating, such as size material, into a paper or board web.

FIG. 4 shows another embodiment for improving the penetration of a coating, such as size material, into a paper or board web. In the embodiment of FIG. 4, before the application of a coating material, on that side $W_1$ of the web to which the coating material or equivalent is applied, an underpressure is created in the pores of the web W to be coated or surface sized, so that in the actual application stage of the coating material an underpressure prevails in the pores of the web, which improves the penetration of the coating material into the web W. In such a situation, the web W sucks into it the coating material that is being applied. To further improve the penetration of the coating material, in the embodiment of FIG. 4, an overpressure is created in the web W immediately after coating, which pushes the coating into the pores of the web subjected to an underpressure.

The technical arrangement in FIG. 4 is shown as follows: The web W is brought to an applicator device 21 such that, before the web W arrives at the applicator device 21, its running direction is turned, i.e. the moving web W is made to curve by means of a roll 23. At the curve, at the side of the "outside curve", i.e. on the side of the first side $W_1$, of the web to which the coating material is applied later, a trough 24 is arranged for guiding the main part of an air flow A coming with the web W away from said first side $W_1$ of the web. Further, a vacuum nozzle 25 is arranged after the roll 23 on the side of the first side $W_1$ of the web, the vacuum created by said vacuum nozzle being used for sucking out as much as possible of the air remaining in the pores. By means of this arrangement, an underpressure is provided in the pores of the web W on the first side $W_1$ of the web. In order that the web W should, however, remain balanced, a second vacuum nozzle 25*a* is arranged after the roll 23 on the side of a second side $W_2$ of the web. This second vacuum nozzle 25*a* also has the effect of causing vacuum in the pores of the web W. The coating of the web W is performed immediately after the vacuum nozzle 25. In the illustration of FIG. 4, a jet applicator is used as the applicator device for producing a coating material jet 22 onto the first side $W_1$ of the web. It is also possible to use other types of coating devices and methods.

Immediately after the coating material jet 22 of the applicator device 21, in the embodiment shown in FIG. 4, an overpressure nozzle 26 is arranged on the side of the first side $W_1$ of the web for blowing air to the surface of the web W to the coated side of the web. In this way, attempts are made to urge the coating material into the pores of the web W by means of an overpressure. In order that the web W should remain balanced, an overpressure nozzle 26*a* is also arranged on the second side $W_2$ of the web, i.e. on the uncoated side of the web W. On the uncoated side it is also possible to use, for example, a perforated plate 27, as an aid for maintaining the balance of the web.

The use of an underpressure/overpressure before and after the coating material jet 22 causes the coating material jet to deflect in the direction of a lower pressure. However, a suitable balance can be sought for this by means of the direction of the coating material jet and pressure differences. In the example of FIG. 4, the gap between the vacuum nozzle 25 and the lip of the jet applicator 21 is sealed with a seal 28. The deflection of the coating material jet can, however, be different if said gap is left without sealing. In the embodiment shown in FIG. 4, the best effect is achieved by using in connection with coating both an underpressure and an overpressure in the manner shown in the figure. However, the possibility of using, only either an underpressure or an overpressure can also be contemplated.

Figure 5:
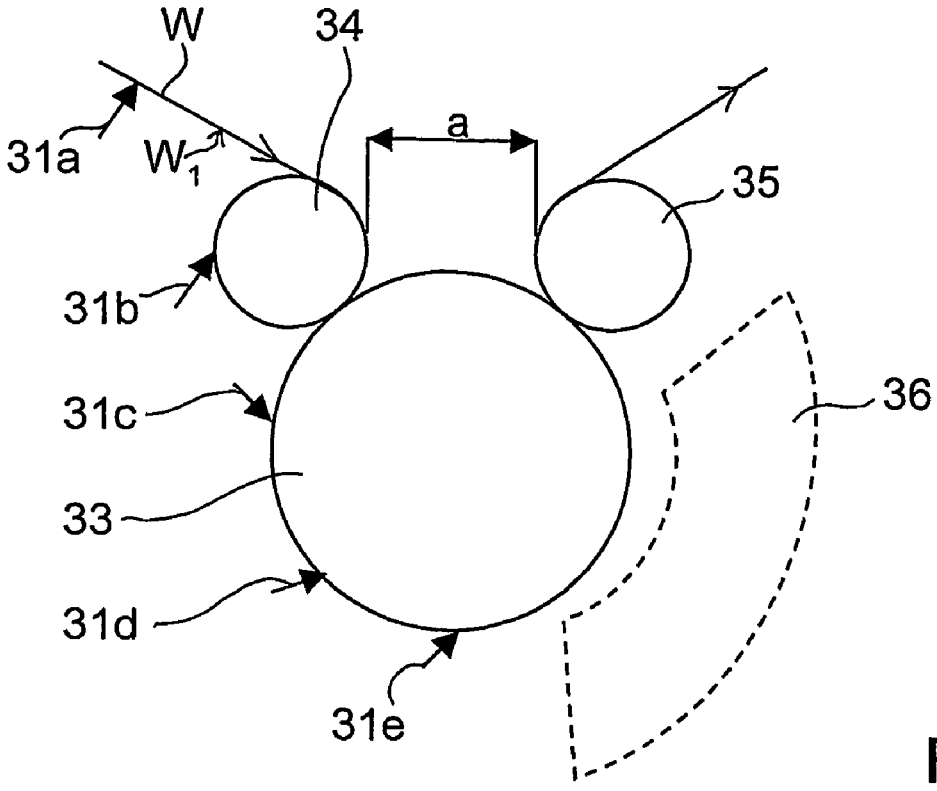
FIGS. 5 and 6 show embodiments for the method in accordance with the invention, in which embodiments a suction roll, inside which there is no special suction box providing a suction zone, is used for producing vacuum.
Figure 6:
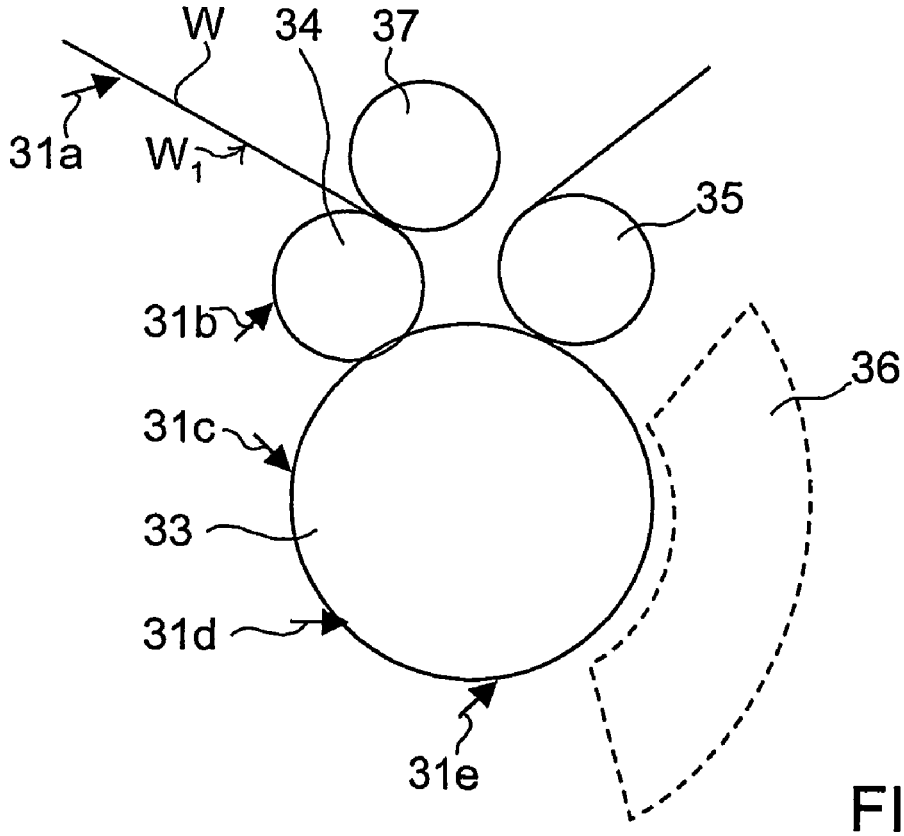

FIGS. 5 and 6 show an arrangement in which, in connection with the application of surface size, starch or equivalent to the web W, a suction roll or a corresponding vacuum roll 33 is used as a vacuum device for causing suction and a vacuum effect over the entire length of the circumference of the roll shell. Inside the roll 33 there is thus no suction box or equivalent device by which a vacuum effect would be directed at a certain sector. In this embodiment, the web W is brought to the vacuum roll 33 by means of a first guide roll 34 and, correspondingly, passed away from the vacuum roll by means of a second guide roll 35. The web W, which is a paper or board web, can be passed for the application of surface size, starch or equivalent and into contact with the vacuum roll 33 either on support of a wire or as such without a wire. If a wire is used, it is placed on that side of the web W that the wire comes into contact with the vacuum roll 33.

The application of surface size, starch, etc. to the web W can be accomplished by means of traditional methods. Thus, application can be performed directly to the web W, as shown with the reference sign 31*a*, for example, by the spray technique or possibly by the blade technique. In certain conditions, it is also possible to use curtain coating. Application can also be performed by the size press technique (so-called sizer technique) as shown with the reference sign 31*b* to the surface of the first guide roll 34, from which the surface size, starch, etc. is transferred to the web W in a nip between the guide roll 34 and the vacuum roll. Application can also be performed directly to the surface of the web, for example, by the sizer technique or the blade technique using the vacuum roll 33 as the backing roll, as indicated by the reference sign 31*c*. Surface size, starch, etc. can be further added after that, when desired, as it has been desired to show by the reference signs 31*d* and 31*e*.

The drying of the web can be started, when needed, already against the vacuum roll 33 by means of a dryer 36. The dryer 36 can be, for example, an infrared dryer, an impingement device or equivalent.

In the illustration of FIG. 5, the distance a between the first guide roll and the second guide roll 35 is fairly large and, in some instances, it may be too large because leakage air is then able to be carried from a large distance into the vacuum roll 33. This, of course, reduces the suction on the web W created by the vacuum roll 33. In the illustration of FIG. 6, attempts have been made to diminish this drawback by moving the guide rolls 34, 35 closer to each other and, further, by providing the arrangement with a sealing roll 37. Leakage air is then able to get into the vacuum roll 33 through a considerably smaller gap.

Figure 7:
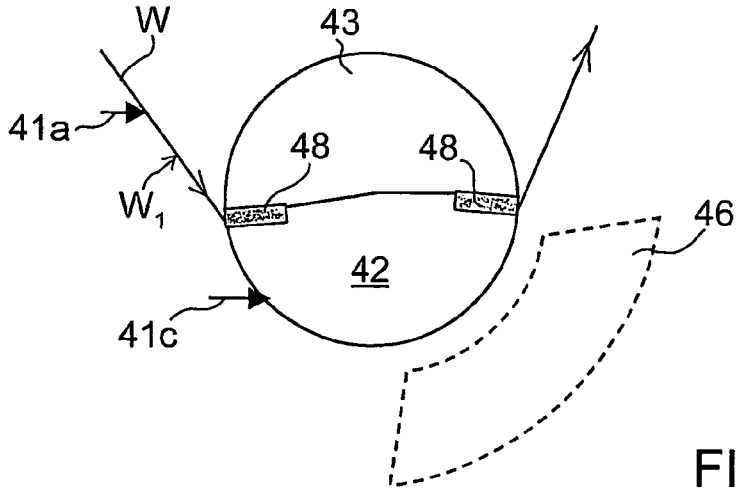
FIGS. 7 and 8 show embodiments in which a suction roll provided with a suction box and, thus, with a suction zone is used for producing vacuum.
Figure 8:
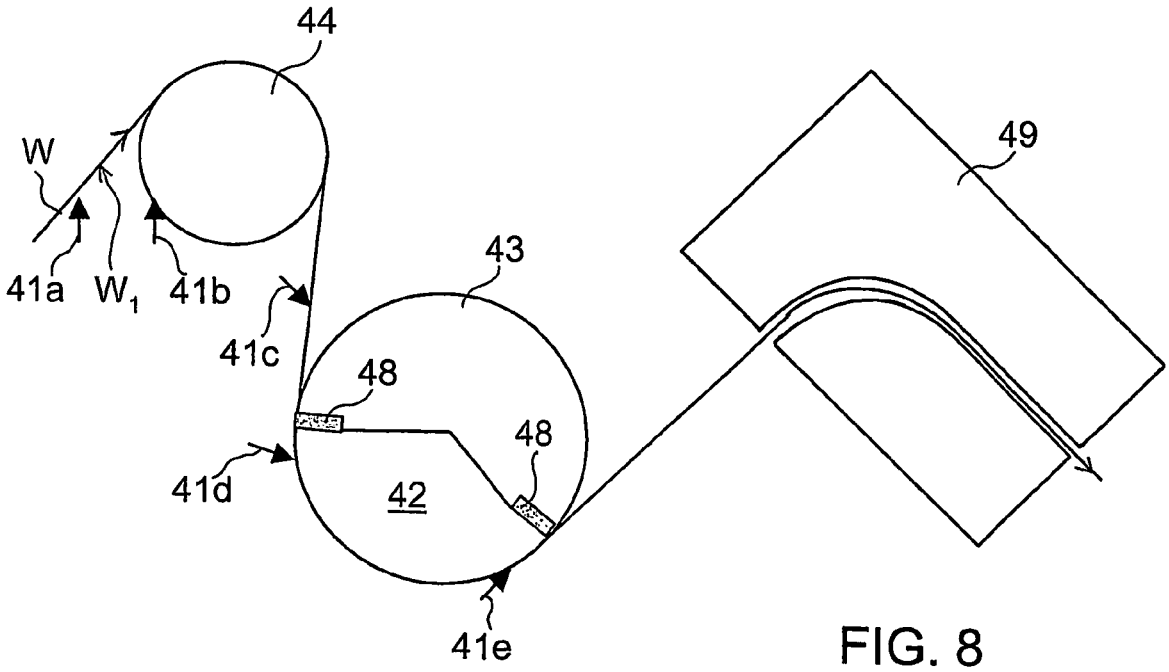

FIGS. 7 and 8 illustrate embodiments in which a suction roll 43 provided with a suction box and, thus, with a suction zone 42 is used for producing vacuum. The suction zone 42 is defined by means of axial seals 48 in a conventional manner. In the illustration of FIG. 7, the web W is passed to the suction roll 43, on which it runs over the suction zone 42. Surface size or starch is applied to a first side $W_1$ of the web at points 41*a* and/or 41*c*, in which connection as application methods it is possible to use, for example, the methods described in connection with FIGS. 5 and 6. The surface size/starch is caused to be sucked into the pores of the web W by means of the vacuum created by the suction zone 42. The drying of the web can be started, when needed, already against the suction roll 43 by means of a dryer 46. The dryer 46 can be, for example, an infrared dryer, an impingement device or equivalent.

FIG. 8 shows an embodiment in which the web W is passed to a suction roll 43 by means of a guide roll 44. Surface size or starch is applied to a first side $W_1$ of the web, for example, using the methods and devices already described in connection with FIGS. 5 and 6. Size application points are shown by means of the reference signs 41*a*, 41*b*, 41*c*, 41*d* and 41*e*. In FIG. 8, the web W is passed from the suction roll to further treatment by means of a contact-free air turning device 49.

Figure 9:
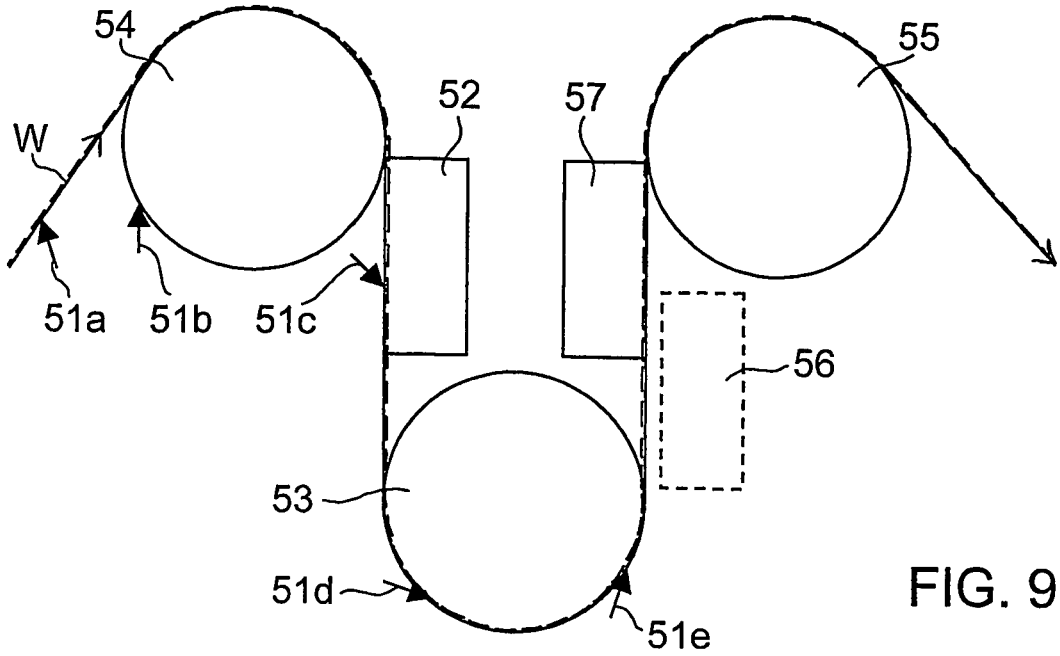
FIG. 9 shows an embodiment in which vacuum is created by means of suction boxes and a suction roll.
Figure 10:
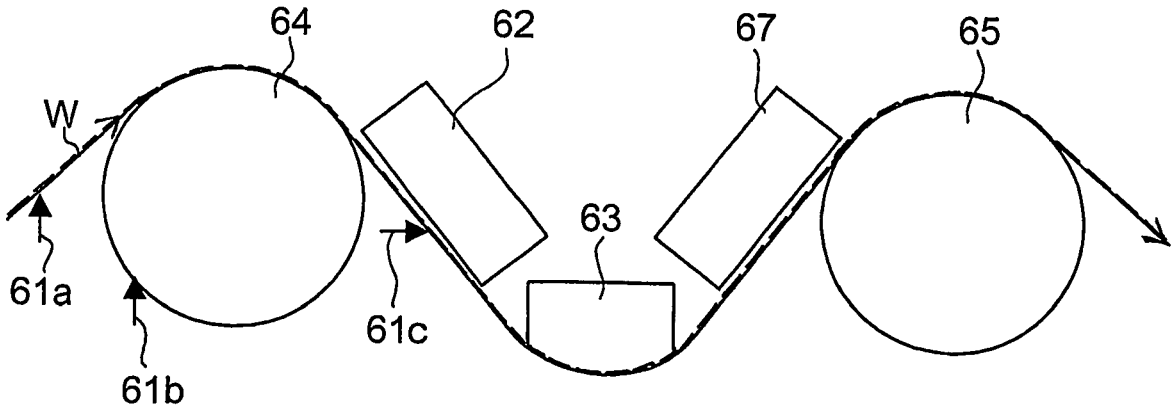
FIG. 10 shows an embodiment in which vacuum is created by means of suction boxes and a suction shoe.

FIGS. 9 and 10 show embodiments in which the necessary vacuum is produced by means of suction boxes and a suction roll or a suction shoe. Suction boxes 52, 57 and a suction roll 53 are used in the example of FIG. 9 and, correspondingly, suction boxes 62, 67 and a suction shoe 63 are used in the example of FIG. 10. In both examples, a wire is used for supporting the web W, by means of which wire the web W is brought for application of surface size. Further, in both cases, the wire is situated on that side of the web W which is on the side of the suction boxes 52, 57; 62, 67 and the suction roll/suction shoe 53/63. The web W is passed to the suction boxes 52, 57; 62, 67 and the suction roll/suction shoe 53/63 by means of a first guide roll 54; 64 and, correspondingly, away from there by means of a second guide roll 55; 65. For size application it is possible to use, for example, the application techniques described above in connection with FIGS. 5-8. Possible size application points are illustrated by means of the reference signs 51*a*, 51*b*, 51*c*, 51*d* and 51*e* in FIG. 9 and by means of the reference signs 61*a*, 61*b* and 61*c* in connection with FIG. 10. FIG. 9 further illustrates that the drying of the web W can be started by a contact-free dryer 56, such as an infrared dryer or an impingement device, already at the size application station. It is also possible to proceed in a similar manner in the example of FIG. 10, although it is not shown in the figure.

Figure 11:
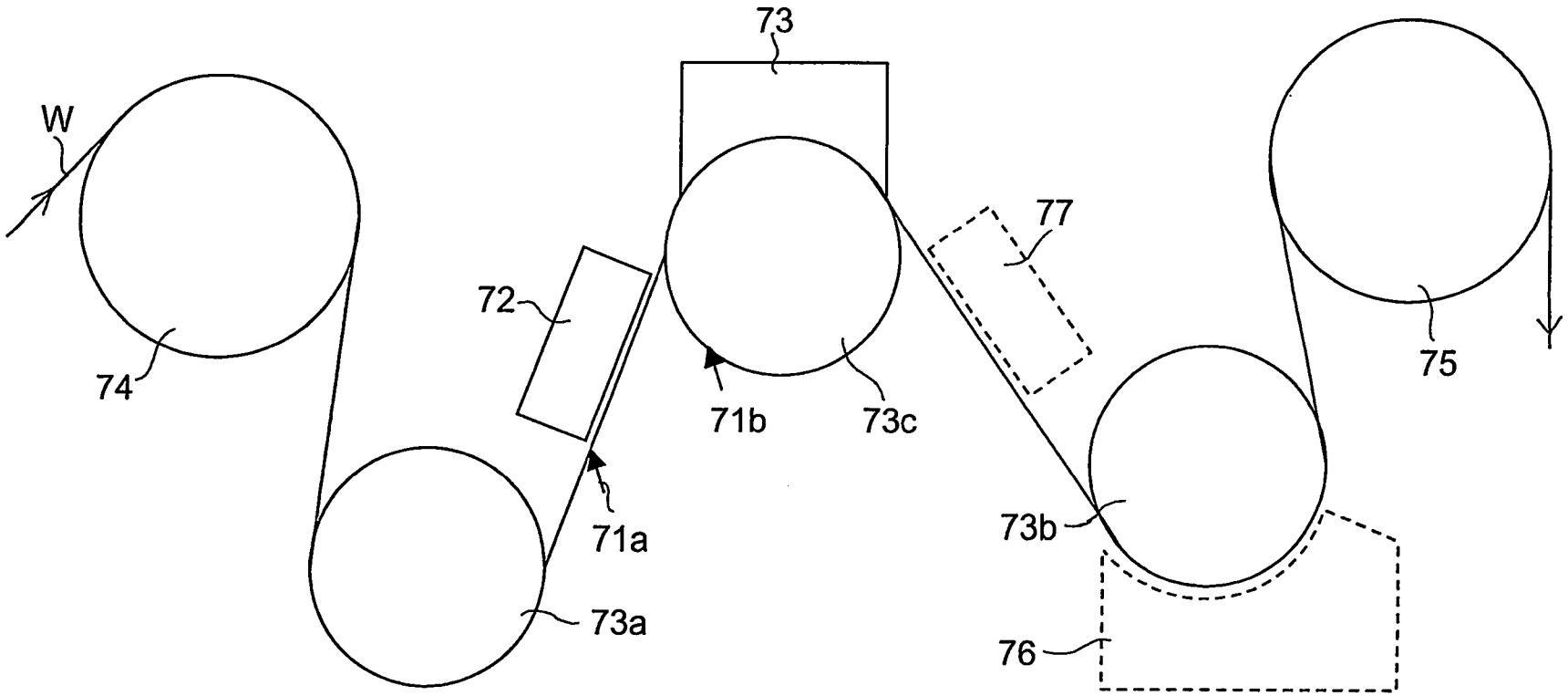
FIGS. 11 and 12 show embodiments in which vacuum is created by means of a curved suction box that cooperates with a roll.
Figure 12:
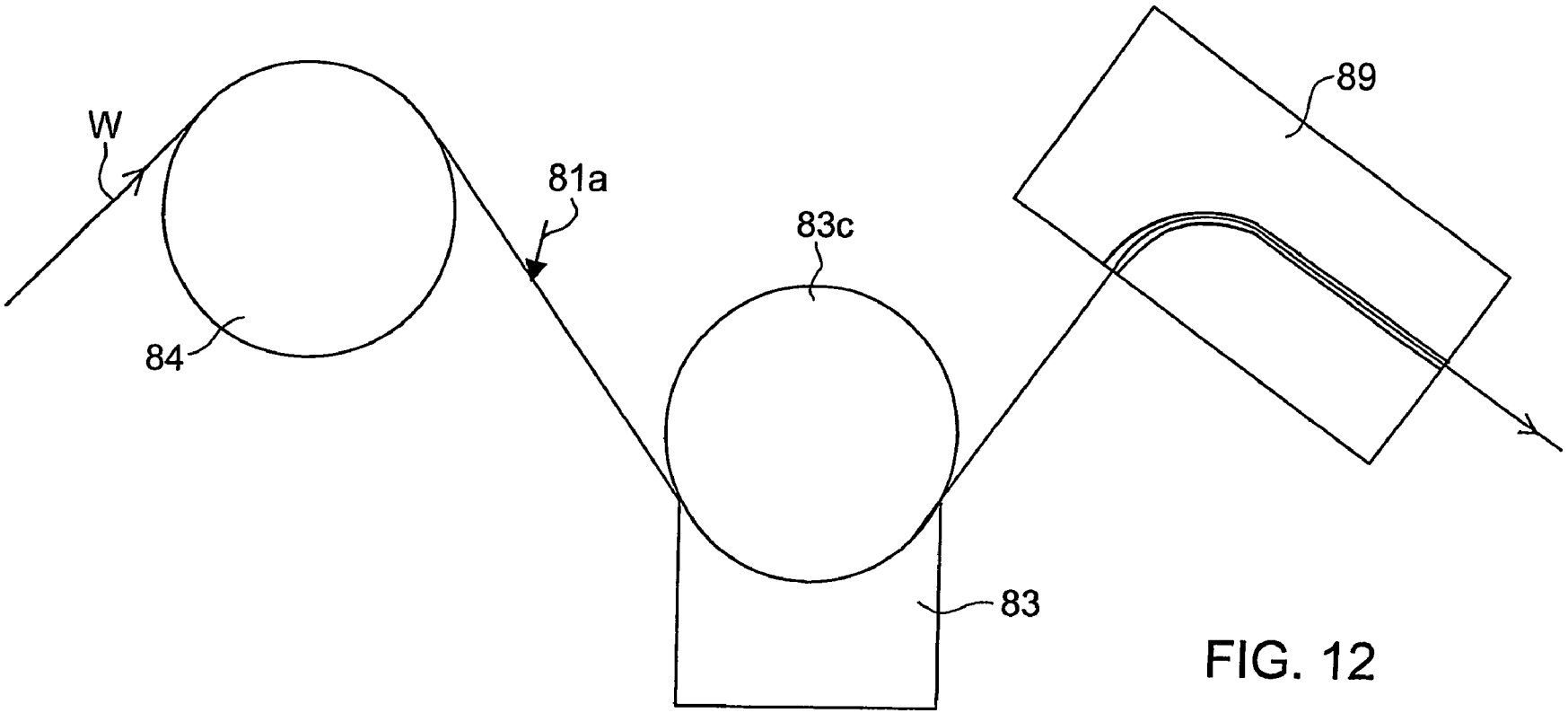

FIGS. 11 and 12 show embodiments in which vacuum is created by means of a curved suction box that cooperates with a roll. FIG. 11 shows an arrangement in which the web W is brought on support of a wire (not shown) from the last drying cylinder 74 of a dryer section or a dryer group for the application of surface size and, after size application, passed further to the first drying cylinder 75 of a subsequent dryer section or dryer group. An arrangement is also possible that the application of surface size to the web W is accomplished in the middle of the dryer section or group, so that the drying cylinders 74, 75 shown in FIG. 11 are successive drying cylinders of the same dryer section or group. The web W is passed from the drying cylinder 74 to a suction roll 73*a* and from it further via a guide roll 73*c* to a second suction roll 73*b*, from which the web runs on support of the wire to the drying cylinder 75. In the illustration of FIG. 11, a suction box 72 is arranged on the run of the web W from the first suction roll 73*a* to the guide roll 71*b*, and further a second suction box 77 can be arranged on the run of the web W from the guide roll 73*c* to the second suction roll 73*b*, as illustrated with broken lines. A curved suction box 73 is placed against the guide roll 73*c* such that the web W runs on support of the wire between the guide roll and the curved suction box 73. The drying of the web W can be started already in the size application area between the drying cylinders 74, 75 using a contact-free dryer 76 placed against the second suction roll, which dryer is, for example, an infrared dryer or an impingement box. The application of size can be performed, for example, by any of the methods and devices already previously described, and possible size application points are denoted in FIG. 11 with the reference signs 71*a* and 71*b*.

In the example of FIG. 12, the web W is brought from a guide roll 84 (or a drying cylinder) to between a curved suction box 83 and a guide roll 83*c* placed against it and passed from it further to further treatment through a contact-free air turning device 89. As in the example of FIG. 11, in this case, too, the treatment of the web is so "rough" that the web runs through the size application stage on support of a wire (not shown). The actual application of size to the web W is performed by any of the methods described previously, and a possible size application point is denoted in FIG. 12 with the reference sign 81*a*.

Figure 13:
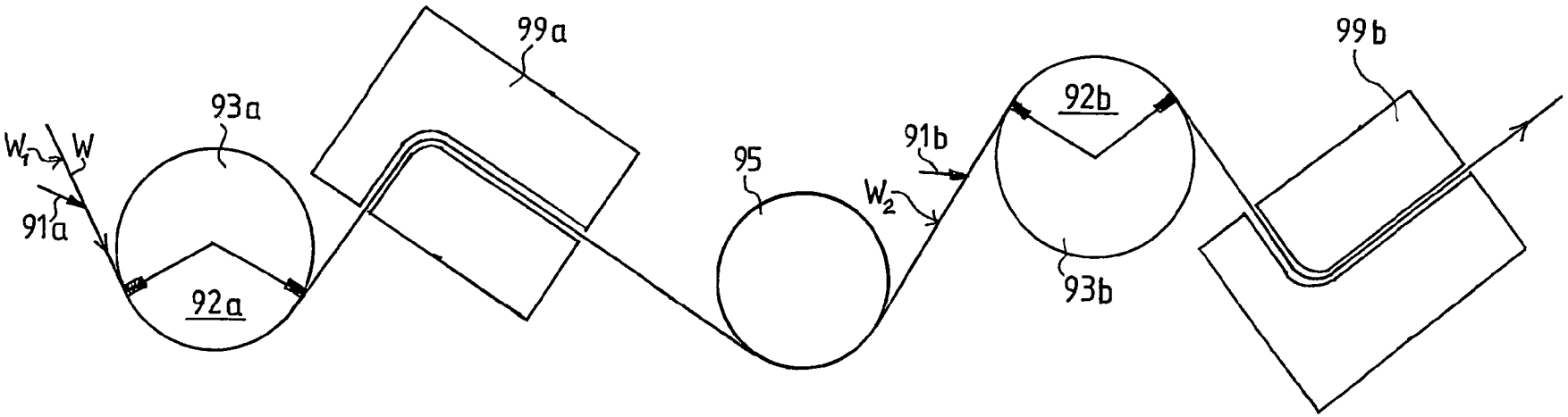
FIG. 13 shows one possible layout of an arrangement in which the web is coated on both sides.

FIG. 13 shows one possible layout of an arrangement in which the web is coated on both sides. In the illustration of FIG. 13, the web W runs through the size application stage as such, i.e. without support of a wire. The web W is brought to a first suction roll 93*a*, which is a suction roll provided with a suction box and a suction zone 92*a*. Before the web is brought to the first suction roll 93*a*, surface size, starch, etc. is applied to a first side $W_1$ of the web by any of the methods described above. A possible first size application point is denoted in FIG. 13 with the reference sign 91*a*. The web W is guided from the first suction roll 93*a* to a first contact-free air turning device/dryer 99*a* and from it further while guided by a guide roll 95 to a second suction roll 93*b*, which is also a suction roll provided with a suction box and a suction zone 92*b*. Before the web is brought to the second suction roll 93*b*, surface size, starch, etc. is applied to a second side $W_2$ of the web by any of the methods described above. A possible second size application point is denoted in FIG. 13 with the reference sign 91*b*. From the second suction roll 93*b* the web W is guided to a second contact-free air turning device/dryer 99*b* and from it further to further treatment.

A common feature to all of the exemplifying embodiments described above is that in connection with the application of a coating material, surface size, starch, etc. a vacuum effect is created in the web for making the material applied to the web to be absorbed better into the web.

Above, the invention has been described by way of example with reference to the examples shown in the figures of the appended drawing. However, the invention is not limited exclusively to the examples shown in the figures, but the different embodiments of the invention can vary within the inventive idea defined in the appended claims.

The invention claimed is:

1. A paper or board web surface sizing apparatus comprising:

a paper or board web having a first side and a second side, and pores leading from the first side and the second side into inner layers of the web, the web following a path through the apparatus defining a running direction;

a turning roll which engages the web to cause the web path to follow a curve, the web having a first side facing away from the turning roll and a second side which engages the roll;

a first vacuum nozzle arranged to suck air from the web after the turning roll to form an vacuum in pores in the web; and an applicator for applying surface size to the web first side, the applicator being positioned after the vacuum nozzle.

2. The apparatus of claim 1 further comprising a trough disposed at the curve and arranged to guide a main part of an air flow traveling with the web, away from the web first side.

3. The apparatus of claim 2 wherein the first vacuum nozzle is arranged to suck air from the first side of the web after the trough.

4. The apparatus of claim 3 further comprising a second vacuum nozzle arranged after the turning roll on the second side of the web, the second vacuum nozzle directed to cause vacuum in the pores of the web.

5. The apparatus of claim 4 further comprising a first overpressure nozzle positioned after the applicator and arranged to put pressure on the first side of the web and a second overpressure nozzle arranged to put pressure on the second side of the web after the applicator.

6. A method of applying surface size to a paper web having inner layers with pores therein comprising the steps of:

guiding an unsupported paper web past a spray coater and spraying a size solution onto a first side of the web; and following spraying the size solution onto the first side, guiding the unsupported paper web around a vacuum roll and applying to a second side opposite the first side a vacuum directly to the unsupported paper web of between 5 kPa and 80 kPa creating an underpressure that sucks the size solution applied onto the first side of the web into pores in inner layers of the web.

7. The method of claim 6 further comprising drying the first side of the paper web with an infrared or impingement dryer over a suction zone of the suction roll.

8. The method of claim 6 further comprising the steps of:

guiding the unsupported paper web through a non-contact dryer after guiding the paper web around the vacuum roll;

guiding the unsupported paper web past a second spray coater and spraying a size solution onto the second side of the web; and following spraying the size solution onto the second side, guiding the unsupported paper web around a second vacuum roll and applying to the first side, opposite the second side, a vacuum directly to the unsupported paper web of between 5 kPa and 80 kPa.

9. A method of applying surface size to a paper web having inner layers with pores therein comprising the steps of:

guiding an unsupported paper web past a spray coater and spraying a size solution onto a first side of the web; and simultaneously while spraying the size solution onto the first side, guiding the paper web around a vacuum roll and applying to a second side opposite the first side a vacuum directly to the unsupported paper web of between 5 kPa and 80 kPa before, during, and after spraying the size solution onto the first side of the web to create an underpressure that sucks the size solution applied onto the first side of the web into pores in inner layers of the web.

* * * * *